United States Patent [19]

Munk

[11] Patent Number: 4,522,332

[45] Date of Patent: Jun. 11, 1985

[54] VOLUME EXPANDING BEVERAGE PACKAGE

[76] Inventor: Werner G. Munk, Bergstrasse 12, D-7981 Vogt über Ravensburg, Fed. Rep. of Germany

[21] Appl. No.: 465,773

[22] Filed: Feb. 11, 1983

[30] Foreign Application Priority Data

Feb. 18, 1982 [DE] Fed. Rep. of Germany ..... 3205751

[51] Int. Cl.[3] ..... B65D 43/08

[52] U.S. Cl. ..... 229/43; 220/258; 366/129

[58] Field of Search ..... 229/7 R, 17 R, DIG. 3, 229/43; 222/92, 95, 107; 366/129, 130; 220/258, 359, 66

[56] References Cited

U.S. PATENT DOCUMENTS

| | | | |
|---|---|---|---|
| 2,739,751 | 3/1956 | Bailey | 229/43 X |
| 2,780,378 | 2/1957 | Romano | 215/11 R |
| 2,894,844 | 7/1959 | Shakman | 220/66 X |
| 3,079,057 | 2/1963 | Colarusso | 229/43 X |
| 3,087,824 | 4/1963 | Ackerman et al. | 220/66 X |
| 3,143,429 | 8/1964 | Swanson et al. | 215/11 R |
| 3,286,902 | 11/1966 | Hunter | 229/7 R |
| 3,301,293 | 1/1967 | Santelli | 150/0.5 |
| 3,301,458 | 1/1967 | Rausing | 229/7 R |
| 3,478,913 | 11/1969 | Kemp | 215/31 X |
| 3,501,045 | 3/1970 | Asmus et al. | 220/258 |
| 3,628,719 | 12/1971 | Ford | 229/52 B |
| 3,795,359 | 3/1974 | Rausing | 229/7 R |
| 3,820,692 | 6/1974 | Swett et al. | 366/129 X |
| 3,826,409 | 7/1974 | Chilcoate | 222/107 |
| 3,952,910 | 4/1976 | Wheeler | 229/7 R |
| 4,211,338 | 7/1980 | Bublitz | 229/43 X |
| 4,328,905 | 5/1982 | Hardt | 220/359 X |
| 4,367,828 | 1/1983 | Reil | 229/7 R |

FOREIGN PATENT DOCUMENTS

| | | | |
|---|---|---|---|
| 2533631 | 2/1977 | Fed. Rep. of Germany | 220/359 |
| 1426750 | 12/1965 | France | 229/7 R |
| 327661 | 4/1930 | United Kingdom | 366/130 |

*Primary Examiner*—William Price
*Assistant Examiner*—Gary E. Elkins
*Attorney, Agent, or Firm*—Horst M. Kasper

[57] ABSTRACT

A non-returnable beverage package is provided where upon opening of the package the volume of the package can be increased. The increase is provided by a cover coordinated with a cup which together constitute the package. This package is particularly suitable for milk shakes. It allows a mixing of the contents of the package before use in an enlarged volume and in a volume adapted to provide turbulent flow to the liquid contained. The package provides for a safe packing of the filled in beverage from the time of filling-in to the time of opening the package.

10 Claims, 5 Drawing Figures

FIG. 2
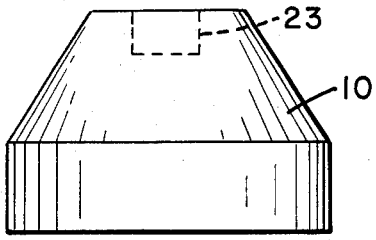
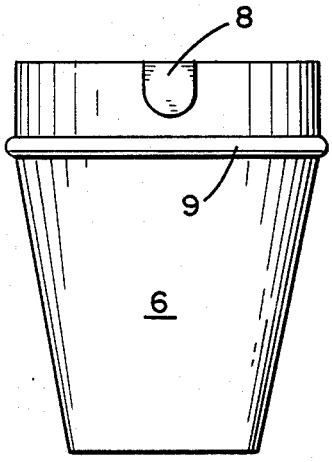
FIG. 1
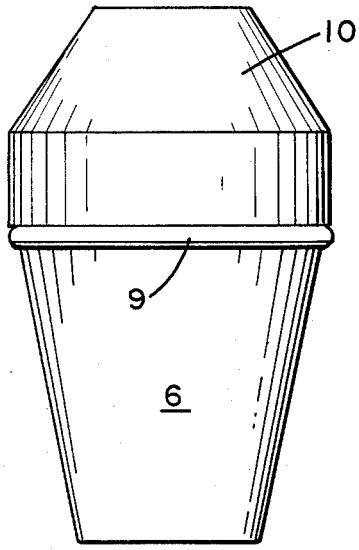
FIG. 3
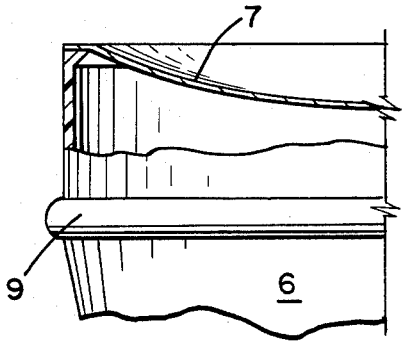
FIG. 4
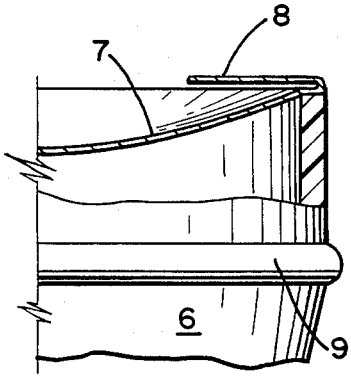
FIG. 5

VOLUME EXPANDING BEVERAGE PACKAGE

BACKGROUND OF THE INVENTION

1. Field of the Invention

The present invention relates to a non-returnable beverage package, in particular for milk shakes, which holds the beverage enclosed and which can be opened for enjoying the beverage.

2. Brief Description of the Background of the Invention Including Prior Art

The sales of milk in recent years have dropped considerably in particular in highly civilized countries, which on the one hand is based on the situation that numerous other beverages are available to the consumer and which on the other hand is based on the milk losing by preparation, transportation and storage much of its original freshness and acquiring an indifferent, sales inhibiting taste.

SUMMARY OF THE INVENTION

1. Purposes of the Invention

It is an object of the present invention to provide a non-returnable beverage package, in particular for milk shakes, which can be used for transportation and storage and which can also serve as a drinking container.

It is another object of the invention to provide a beverage container which can be employed to refresh the beverage contained before consumption.

It is a further object of the invention to provide a non-returnable beverage container, which allows to shake the beverage vigorously before use possibly under addition of further ingredients.

These and other objects and advantages of the present invention will become evident from the description which follows.

2. Brief Description of the Invention

The present invention provides a non-returnable beverage package for enclosing a beverage and capable of being opened for having and enjoying the beverage, which comprises a container for the beverage adapted to be capable of expanding the volume available for the beverage in the container.

Preferably a means is provided for enlarging the volume by at least about 20 percent and more preferably from about 30 to 60 percent. Means can be provided for reclosing the beverage container.

The beverage container can comprise a cup sealed with a covering foil and a coordinated cover for sealing liquid. The cover itself can provide an internal volume and it can be formed as a hood. The cover can comprise a container part for enclosing additional ingredients for preparing shake drinks. The container part and the cover can be connected and one wall of the container part can be formed by the cover wall. The covering foil can be provided with a grip flap, which is bent over upwardly. and the cover can be slid onto the cup. The cup can comprise a circularly surrounding stop serving as an abutment for the slid on cover. A beverage can substantially fill the volume available in the package.

There is also provided a method for furnishing beverages to end-users in packages which comprises producing a container adapted to have its internal volume expanded by the end-user, filling the container with a beverage, sealing the container filled with the beverage, opening a seal provided at the container, expanding the container, and agitating the beverage in the container. A flap can be provided at the top of the container and a seal can be disposed under the flap allowing for bending of the flap, opening the seal and followed by reclosing of the container.

The novel features which are characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention:

FIG. 1 a schematic side view of a cup-shape formed non-returnable package

FIG. 2 is a schematic side view of a cover coordinated to the cup-shape formed non-returnable package, FIG. 3 is a schematic side view of the non-returnable package shown in FIGS. 1 and 2 with slid up cover, and FIG. 4 is an in part sectional view of the upper edge region of the cup shown in FIGS. 1 to 3 at an enlarged scale.

FIG. 5 is an alternate embodiment of the upper edge region of the cup shown in FIG. 4.

DESCRIPTION OF INVENTION AND PREFERRED EMBODIMENTS

In accordance with the present invention there is provided a non-returnable beverage container package, in particular for milk shakes, enclosing the beverage and adapted to be opened for enjoying the beverage, where the volume provided to the beverage in the package is expandable such that the possibility exists to shake the contents of the package more or less strongly. In fact, it has been found that milk and milk shakes recover already upon shaking before the enjoyment and consumption much of their original freshness. A foam formation caused by shaking is felt to be pleasant by the consumer. Such shaking is not possible with the conventionally known non-returnable beverage packages, since they lack the additional packing volume required for shaking. In their case the packing volume is completely filled with beverage in order to save unnecessary transport volume and to prevent a head cream formation by shaking during transport, which is undesired by the consumer.

The invention package represents a non-returnable package, which on the one hand serves as a transporting and storage vessel and which on the other hand serves as a shaker and a drinking vessle.

The beverage container of the present invention is particularly suitable for beverage concentrates. Employing the beverage container of the present invention, a concentrate can be shipped to the consumer taking up only a small shipping volume and the consumer can open the container and add a desired liquid such as water or milk and then shake the mixture to get a homogeneous beverage. This is particular attractive in areas where customarily water fountains are provided on many premises or for restaurants, where the patron is assured to receive the package with the desired brand name at the table. In addition, the invention package is suitable for frozen concentrates such as for example orange juice concentrate, lemon juice concentrate or apple juice concentrate and would allow the addition of water into the package of the concentrate for preparing the desired juice.

The volume of the package provided to the beverage can be increased by at least 20 percent, and preferably by 30 to 60 percent, which allows to perform easily a vigorous shaking of the package before consumption.

In order to avoid an undesired splashing of the beverage during shaking, the invention package can be reclosable after the opening, reference to which will be made in particular by way of preferred embodiments set forth in the following description.

The volume provided to the beverage in the originally sealed package is preferably closed off by way of at least one removable and/or push-through surface section, which is preferably a foil, such that on the one hand a safe transport and on the other hand an easy opening of the package is assured.

According to a preferred embodiment, the receiving volume of the package can be decreased by an essentially reversible deformation of the package wall, where this deformation can be set back by opening of the package. Such a reversible deformation can be achieved for example by pressing the package more or less slightly together from the outside and filling it only then. The package wall bulging to the inside assumes then after the opening again its original form such that then the full receiving volume is available to the beverage and that the contents of the package can be shaken.

According to a preferred embodiment, the invention non-returnable package comprises a closed cup preferably produced from plastic and closed with a covering foil for sealing liquids and a closing cover sealing against liquids is coordinated to the cup. The additional package volume required for shaking can in this case be achieved either by having the cup filled only to about 80 percent and then covering the same with a covering foil pulled inwardly by way of a vacuum. In this case, a more or less planar closure cover can be provided for the cup.

The additional package volume required for shaking can in this case also be achieved by filling the cup more or less completely and then covering it with a planar covering foil and by providing an outwardly bulged closure cover after removal of the covering foil. This means that the cover coordinated to the cup can be provided with its own volume, for example by forming it as a hood.

A container part for additives and ingredients for the preparation of mixed milk shakes can be comprised in the cover coordinated to the cup. This container part can be solidly connected to the cover, where one wall of the container part is provided by the inside of the cover.

The cup-cover foil can be provided with a grip flap, which is preferably bent over to the upper side such that the cover can be slid onto the cup without being interfered with by the covering foil. In addition, the cup can be provided with a stop serving as an abutment for the slid on cover.

The non-returnable package shown in FIGS. 1 to 5 comprises essentially a cup 6 with the shape of a truncated cone, which is preferably produced from plastic and which is closed with a covering foil 7 for sealing liquids. The covering foil 7 is provided with a grip flap 8 which is turned over outwardly according to FIG. 1 and which is turned over upwardly according to FIGS. 4 and 5. The beaker or cup 6 is provided in the upper region with a circularly surrounding protrusion or stop 9, which serves as an abutment for a cover 10 to be slid on from above onto the cup 6.

The upper edge of the cup 6 can be made thicker (compare FIG. 5) or can be provided with an inner edge (compare FIG. 4) for attaching of the covering foil 7 and the attachment is preferably provided adhesively. Both possibilities provide sufficient stiffness to the upper edge of the beaker or cup 6 in order to allow a liquid sealing closure with the cover 10.

The covering foil 7 can be initially formed pulled inwardly as is shown in FIGS. 4 and 5. This provides the advantage that the cup 6 is not completely filled with beverage after removal of the covering foil. It is furnished on the contrary with sufficient additional volume capacity such that if desired, additional ingredients or additives can be added to the beverage in cup 6 for producing of a mixed beverage such as for example fruit preparations, spice and/or herb mixtures, and foam generating ingredients without that the cup 6 would run over. By sliding on of the cover 10 the volume capacity of the cup 6 is in addition increased such that the contents of the cup can be shaken.

The previously mentioned additional ingredients can be disposed for example in a small container part 23 located in the interior of the cover 10 before being filled into the cup 6. The cup 6 can be additionally provided with a bellows section corresponding to the bellows 1 of the parallelepipedal container. If desired, a volume increase can be further achieved for the cup 6 by filling it for example to only 80 percent with beverage and then closing it under vacuum with the covering foil 7 such that the wall regions of the cup 6 bulge inwardly and then after removal of the covering foil they provide an increase in the available volume of the cup 6 based on their own restoring force.

It will be understood that each of the elements described above, or two or more together, may also find a useful application in other types of system configurations and beverage and food or liquids and solids distribution procedures differing from the types described above.

While the invention has been illustrated and described as embodied in a non-returnable beverage package system, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific of this invention.

What is claimed as new and desired to be protected by Letters Patent is set forth in the appended claims.

I claim:

1. A non-returnable beverage package for enclosing a beverage and capable of being opened for having, and enjoying the beverage comprising a container having rotation symmetry for the beverage adapted to be capable of expanding the volume available for the beverage in the container based on a cup sealed with a covering foil where the container has an upper about cylindrical section constructed to fit closely under a cylindrical section of a hood cover, an outer bead surrounding the lower edge of the cylindrical part and adapted to support and match the hood edge, a lower frustro-conical part adjoining the outer bead, and a closed bottom; and a coordinated cover for sealing liquid for enlarging the volume provided to the beverage in the package, where the cover provides volume itself and is formed as a hood having a lower about cylindrical portion and an upper frustro-conical part, which is closed at the top.

2. The non-returnable beverage package according to claim 1 wherein the cover comprises a separate container part for enclosing additional ingredients for preparing shake drinks.

3. The non-returnable beverage package according to claim 2 where one wall of the container part is formed by the cover wall.

4. The non-returnable beverage package according to claim 1 wherein the covering foil is provided with a grip flap, which is bent over upwardly, and where the cover can be slid onto the cup.

5. The non-returnable beverage package according to claim 1 wherein the cup comprises a circularly surrounding stop serving as an abutment for the slid-on cover.

6. The non-returnable beverage package according to claim 1 wherein the upper cylindrical section of the container is made with thicker material as compared to the frustro-conical part.

7. The non-returnable beverage package according to claim 1 further comprising an inner edge at the upper end of the cylindrical section for attaching the covering foil.

8. A non-returnable beverage package for enclosing a beverage and capable of being opened for having, and enjoying the beverage comprising a cup portion comprising a bottom, a frustro-conical section adjoining the bottom and expanding upwardly, a protrusion surrounding the upper end of the frustro-conical part, a cylindrical section adjoining the protrusion;

a hood portion comprising a lower cylindrical part to be slid over the cylindrical part of the cup, an upper hood section following to the cylindrical section and having a frustro-conical shape and closed at the top;

where upon sliding of the lower cylindrical part of the hood onto the cylindrical part of the cup the volume capacity of the cup is increased such that the contents of the cup can be shaken, a covering foil pulled inwardly where the covering foil is supported at its edge by the the upper cylindrical portion of the cylindrical section of the cup.

9. The non-returnable beverage package according to claim 8 wherein the upper cylindrical part of the container is made with thicker material as compared to the conical part.

10. The non-returnable beverage package according to claim 8 further comprising an inner edge at the upper end of the cylindrical part for attaching the covering foil.

* * * * *